US006670722B1

(12) United States Patent
Kessell et al.

(10) Patent No.: US 6,670,722 B1
(45) Date of Patent: Dec. 30, 2003

(54) BOAT IGNITION SAFETY APPARATUS AND METHOD

(76) Inventors: Roy P. Kessell, 2705 - 13th St., Cuyahoga Falls, OH (US) 44223-2213; Russell A. Hercules, 419 Grove Ave., Cuyghoga Falls, OH (US) 44221

( * ) Notice: Subject to any disclaimer, the term of this patent is extended or adjusted under 35 U.S.C. 154(b) by 203 days.

(21) Appl. No.: 09/950,032

(22) Filed: Sep. 10, 2001

Related U.S. Application Data

(63) Continuation-in-part of application No. 09/634,432, filed on Aug. 8, 2000.

(60) Provisional application No. 60/147,797, filed on Aug. 9, 1999.

(51) Int. Cl.[7] ..... B60L 1/00

(52) U.S. Cl. ..... 307/9.1; 123/179.3; 123/406.26; 123/625; 114/211; 454/78

(58) Field of Search ..... 123/179.3, 179.18, 123/179.16, 406.26, 625; 55/385.3, 385.4; 73/35.17, 116; 324/378, 380; 340/632; 307/9.1; 114/211; 454/78

(56) References Cited

U.S. PATENT DOCUMENTS

| | | | | |
|---|---|---|---|---|
| 1,285,659 A | | 11/1918 | Ford | |
| 3,489,912 A | | 1/1970 | Hoffman | |
| 3,652,868 A | | 3/1972 | Hunt | |
| 3,948,202 A | | 4/1976 | Yoshikawa | |
| 3,951,091 A | | 4/1976 | Doench | |
| 4,037,578 A | | 7/1977 | Dersch et al. | |
| 4,134,112 A | * | 1/1979 | Kercheval et al. | 340/632 |
| 4,185,605 A | * | 1/1980 | Largent, Sr. | 123/179.3 |
| 4,235,181 A | | 11/1980 | Stickney | |
| 4,473,025 A | | 9/1984 | Elliott | |
| 4,944,241 A | | 7/1990 | Carter | |
| 4,991,532 A | | 2/1991 | Locke | |
| 5,050,520 A | | 9/1991 | Ballard | |
| 5,069,154 A | | 12/1991 | Carter | |
| 5,185,568 A | | 2/1993 | Mothersbaugh et al. | |
| 5,233,226 A | | 8/1993 | Hanover et al. | |
| 5,664,515 A | | 9/1997 | Hattori et al. | |
| 5,787,833 A | | 8/1998 | Lewis | |

* cited by examiner

*Primary Examiner*—Shawn Riley
(74) *Attorney, Agent, or Firm*—Hahn Loeser & Parks, LLP

(57) ABSTRACT

A boat ignition safety apparatus and method that prevents a gasoline engine of a boat from being started until the enclosed engine compartment has received proper ventilation for a predetermined period of time to ensure dangerous gasoline fumes have been removed. The invention uses an air pressure sensor to detect fresh air drawn into an engine compartment by a ventilation fan or blower. When this takes place a positive pressure develops within the engine compartment. This positive pressure is detected by the air pressure sensor and indicates that the ventilation fan or blower is operating properly. The present invention makes boating safer by ensuring adequate ventilation of volatile gasoline fumes, thereby preventing accidental explosions that can occur when a boat's engine is started.

20 Claims, 11 Drawing Sheets

BOAT IGNITION SAFETY APPARATUS AND METHOD

The present invention relates to marine safety equipment, and more particularly to a safety apparatus and method that prevents ignition of a boat's gasoline engine until an engine compartment has received proper ventilation for a predetermined period of time. This application is a C-I-P of U.S. application Ser. No. 09/634,432, filed on Aug. 8, 2000, which claims the benefit of U.S. Provisional Application No. 60/147,797, filed on Aug. 9, 1999. The present invention is also the subject of Disclosure Document No. 455,716 dated Apr. 26, 1999, which was received by the U.S. Patent and Trademark Office on Apr. 30, 1999.

TECHNICAL FIELD

BACKGROUND OF THE INVENTION

Boats are generally powered by gasoline engines, which are typically mounted in enclosed compartments in either a boat's hull, or in an area toward its stern. As a result, when the engine is not in operation, volatile fumes from the fuel emanate from the engine and its surrounding components. These fumes quickly accumulate within the enclosed engine compartment reaching a concentration substantial enough to become a hazard for explosion. Furthermore, because of the mechanical and electrical components involved in a combustion engine, it is very likely that electrical charges or sparks may be emitted throughout the surrounding engine compartment. Because of the engine compartment's volatile environment, conditions are highly conducive for the occurrence of an explosion. To prevent these fumes from exploding when the engine is started, the gas fumes must be exhausted from the engine compartment prior to starting the boat's engine. If the enclosed engine compartment is not properly exhausted, the boat could explode thereby endangering the safety of the boat's passengers and others nearby.

Today, all boats that have inboard motors include a fan in the engine compartment for exhausting fuel fumes. Further, current federal regulations and safety operating guidelines suggest using a powered ventilation system for at least four minutes before a boat is started. However, boaters are not likely to be aware of how long to ventilate the engine compartment to properly prevent the concentration of hazardous fuel fumes. In addition, many boaters may unintentionally forget to turn on the ventilation fan, if they are not reminded to do so in some fashion. Finally, other boaters may intentionally avoid activating the exhaust fan if they have the ability to start the engine independently of the exhaust fan.

Therefore, in light of the foregoing deficiencies in the prior art, the applicant's invention is herein presented.

SUMMARY OF THE INVENTION

The present invention is directed to a boat ignition safety apparatus and method, which prevents the engine of a boat from being started until there has been continuous positive air flow within an engine compartment for a predetermined period of time to ensure adequate ventilation of gasoline fumes. Thus, the present invention ensures that volatile fumes do not collect in an engine compartment, which poses the threat of an explosion.

Today, many areas allow both boating and docking in and around shoreline recreation areas where people swim and engage in beach related activities. Furthermore, because of the popularity of beach and water recreation, these areas are often highly populated. Because of the number of boaters and beach goers sharing common water areas, the distance boaters are from these shoreline recreation areas has decreased, thereby increasing the chances of great harm to people located in these areas if a boat were to explode. However, the present invention provides the boater with the appropriate safety measures to avoid such a result.

It is an object of the present invention to prevent a boat engine from starting until continuous, positive air flow has been detected within the engine compartment for a predetermined period of time in order to ensure proper ventilation of fumes from the engine compartment.

A further object of the present invention is to make boating safer by preventing accidental explosions of boats caused when gasoline engines are started prior to adequate ventilation of enclosed engine compartments.

The advantages that the present invention provides in terms of functionality and utility will be further made apparent when the detailed description is read in conjunction with the applicable drawings and claims.

DETAILED DESCRIPTION OF THE PREFERRED EMBODIMENT

In the following detailed description of embodiments of the present invention, reference is made to the accompanying drawings which, in conjunction with this detailed description, illustrate and describe an apparatus for preventing a boater from starting an engine until a ventilation fan has removed volatile fumes from an engine compartment. The invention may also be embodied in many different forms and should not be construed as limited to only the disclosed embodiments. The provided embodiments are included so the disclosure will be thorough, complete and will fully convey the scope of the invention to persons of ordinary skill in the art.

Figure 1:
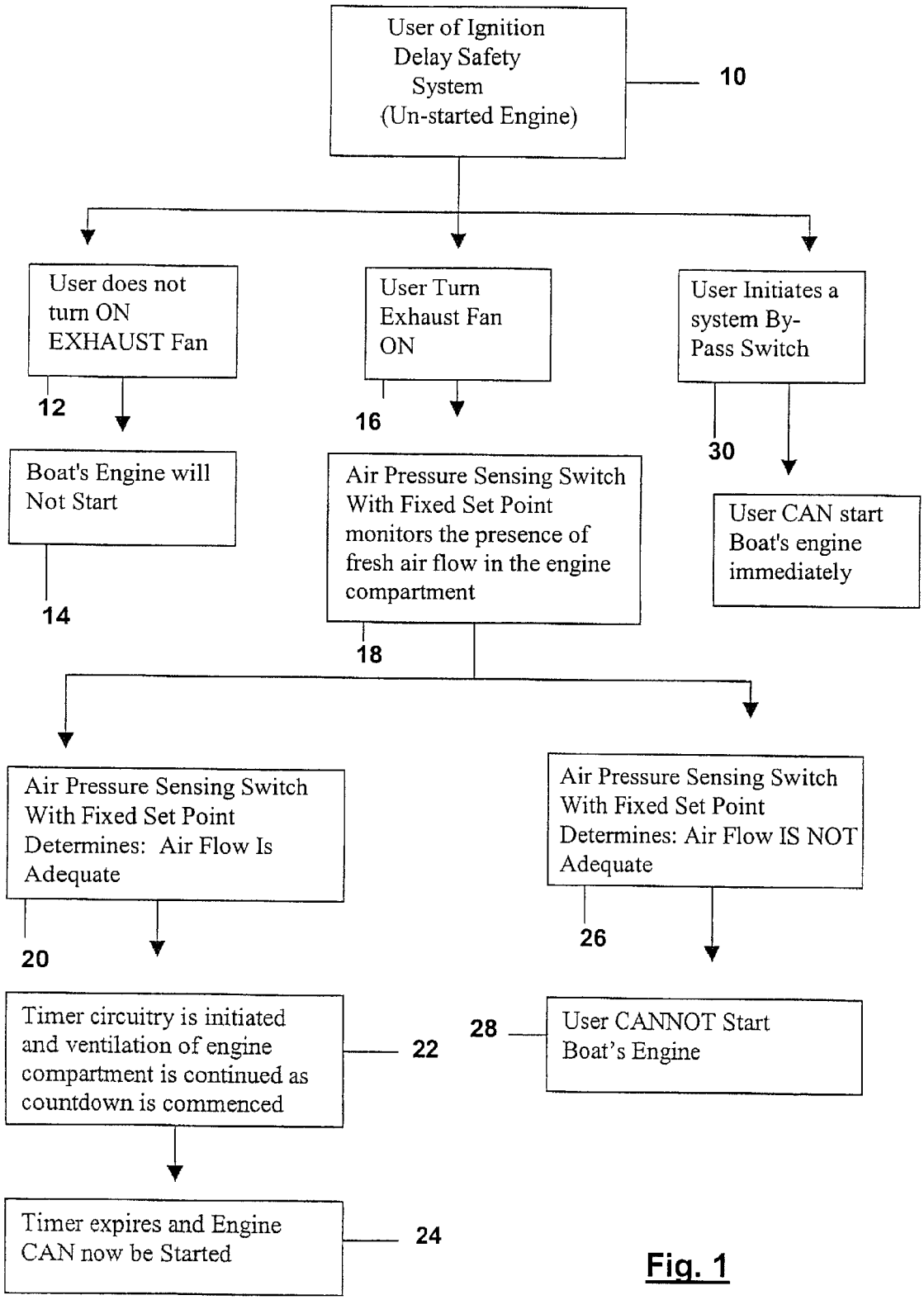
FIG. 1 is a block diagram of the general functionality of the boat ignition safety apparatus.
Figure 2:
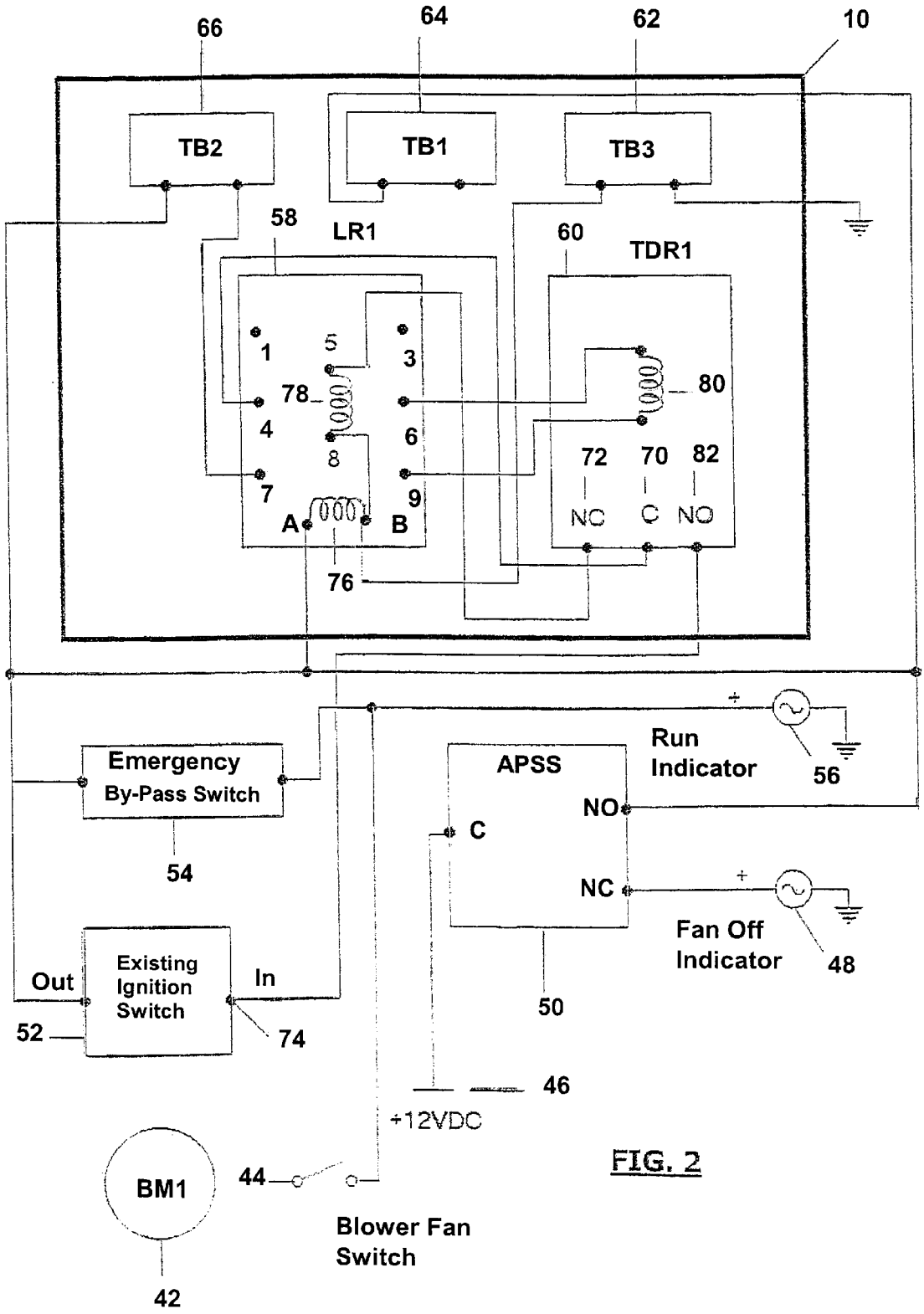
FIG. 2 is a schematic diagram of the boat ignition safety apparatus of the present invention.
Figure 4:
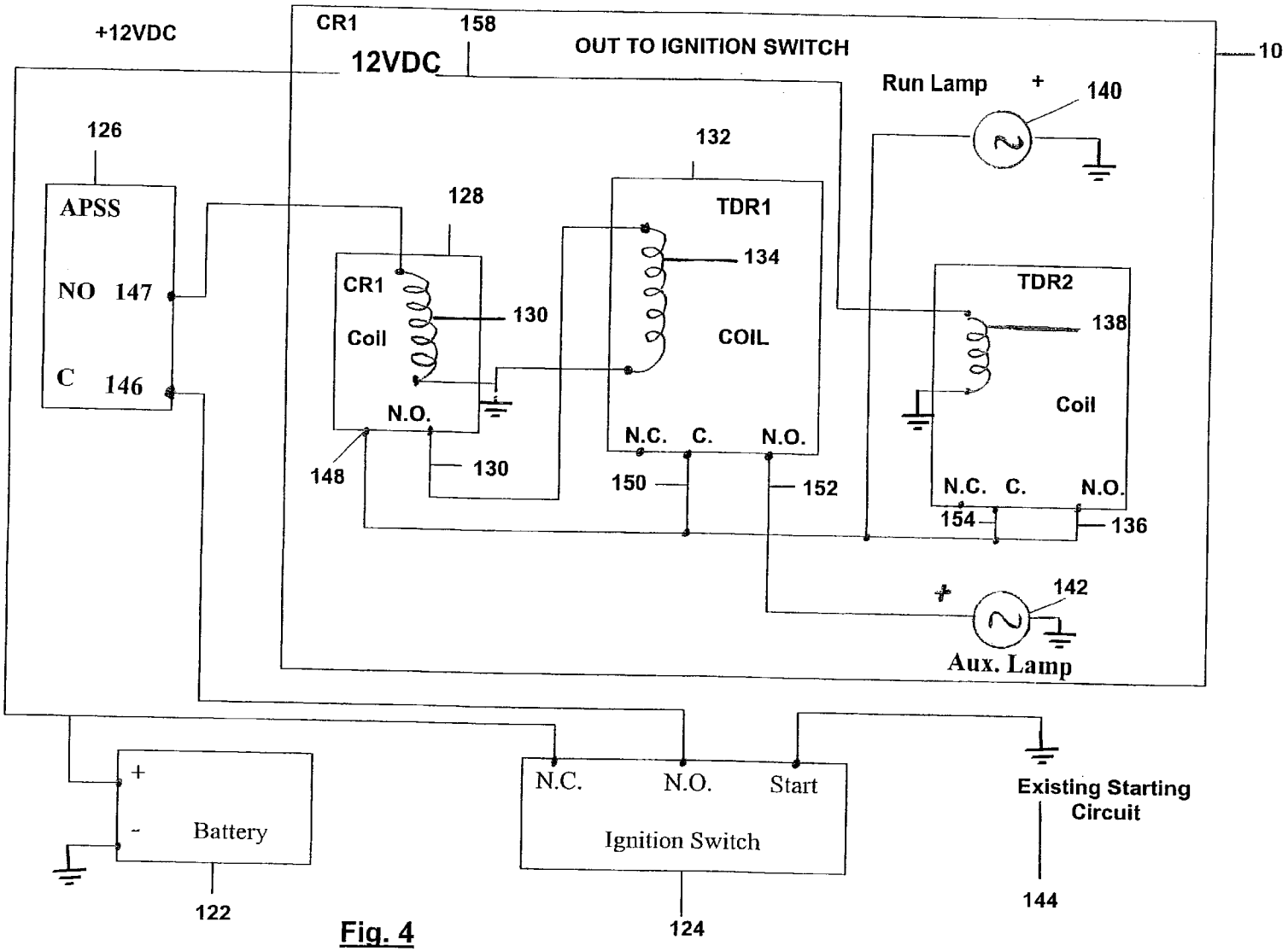
FIG. 4 is a schematic diagram of an alternate embodiment of the boat ignition safety apparatus.
Figure 5:
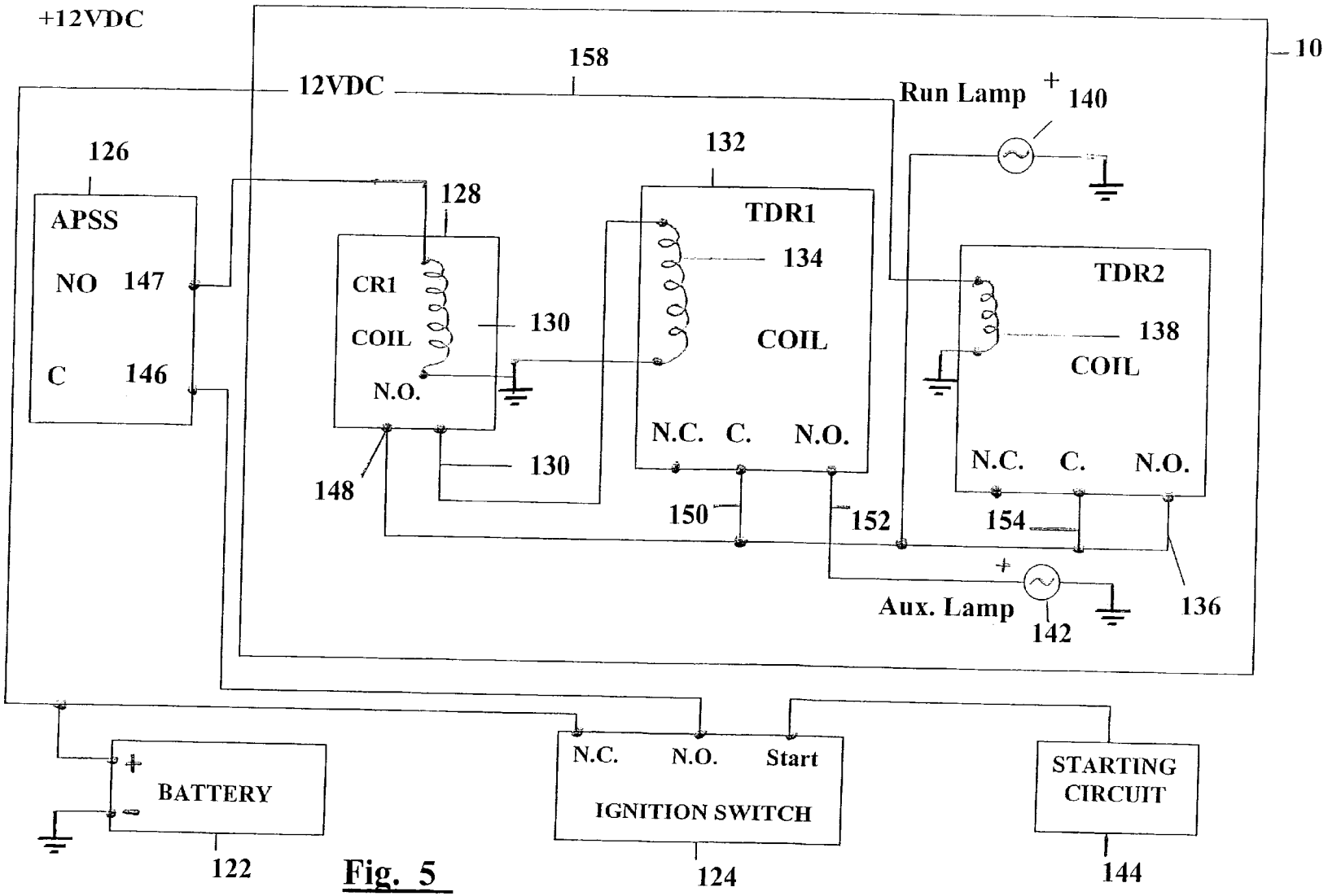
FIG. 5 is a schematic diagram of the embodiment in FIG. 4 showing internal and external wiring connections for the present invention.

FIG. 1 is a block diagram of the general functionality of the boat ignition safety apparatus 10. When preparing to start a boat's engine, the first step is for the user to turn on 16 the ventilator. In one preferred embodiment the ventilator comprises an exhaust or ventilation fan 92 (see FIG. 3). If the user does not turn on 12 the exhaust fan 92, then the engine will not start 14. In an alternate embodiment, not only will the engine not start 14 but the exhaust or ventilation fan 92 will be automatically turned on. After the user turns on 16 the exhaust fan 92 (or it is turned on automatically), an air pressure sensor 96 (see FIG. 3) monitors 18 the presence of positive air flow in the engine compartment 98. The air pressure sensor 96 determines whether the exhaust fan 92 is clearing the engine compartment 98 of volatile gasoline fumes. FIGS. 2, 4 and 5 show similar air pressure sensors 50 and 126. Reference numerals 50, 96 and 126 are used interchangeably to refer to air pressure sensing switches because the present invention uses the switches that are triggered by variations in air pressure. One of ordinary skill in the art would understand that separate air pressure sensors and switches could be used in place of an air pressure sensing switch.

In a preferred embodiment, air pressure sensor 96 is an air pressure sensing switch such as Model RSS-495-11 sold by Cleveland Controls. The air pressure sensing switch is comprised of a housing containing a diaphragm and a snap-acting switch. Barbed sample line connectors on each side of the diaphragm accept flexible tubing. The snap-action switch can be actuated by a positive or negative pressure, or by a pressure differential. The switch includes normally open, normally closed and common connect terminals. The air pressure sensing switch has an adjustable set point range that is set to a predetermined set point for use in the present invention. To adjust the sensitivity of the air pressure sensor 96, the adjustable set point of the air pressure sensing switch can be altered. In the boat ignition safety apparatus 10 of the present invention, the air pressure sensor, implemented with an air pressure sensing switch, is configured to detect positive pressure within an engine compartment. When fresh air is drawn into an engine compartment by a ventilation fan or blower in order to flush fumes out from the engine compartment, a positive pressure develops within the engine compartment. This positive pressure is detected by the air pressure sensor and indicates that the ventilation fan or blower is operating properly.

Use of an air pressure sensor in the present invention provides a number of advantages over prior art boat ignition safety devices. In particular, prior art boat ignition safety devices were adversely affected by the direction of air flow, the devices orientation and forces applied to the prior art devices due to acceleration and deceleration. Because the present invention includes an air pressure sensing switch it can detect air flow from all directions. Prior art devices use a sail and cam arrangement that will only trigger a separate switch if air flows in one direction to push the sail and cam into the switch.

Another advantage provided by the use of an air pressure sensing switch is that it can be mounted within the boat in almost any orientation, making the boat ignition safety apparatus easily adaptable to different types of boats. Prior art devices, such as that disclosed in U.S. Pat. No. 5,050,520, will only detect air flow if the mechanical sensory device, made up of a sail, cam and switch, are within a horizontally mounted vent tube. If the vent tube where mounted vertically with the intake side of the vent tube upward, the position of the sail changes and triggers the switch. If the intake side of the tube were mounted vertically with the intake side of the tube downward, the position of the sail changes away from the switch and never triggers the switch. The prior art devices requires that the vent tube always be positioned so that air flow works the sail properly. The use of an air pressure sensing switch in the present invention does not depend on a sail, cam and switch arrangement, only the detection of positive air pressure. Therefore the air pressure sensing switch can be mounted in any position, making the device much more convenient to mount and/or retrofit in boats.

A further advantage of the use of an air pressure sensing switch in the present invention is that it is unaffected by forces due to acceleration and deceleration of the boat. Because the prior art devices use a mechanical sensory device, i.e., a sail, cam and switch, they have mass, which a sudden force from acceleration or deceleration could activate due to inertia. For example, if a boat were to slam into a wave or surf down the face of a wave, this motion would cause a change in the position of the sail and thereby detect forces of acceleration rather than air flow. Because the present invention monitors and detects air pressure, the detection method has little mass and forces due to acceleration and deceleration do not affect the results.

Once an adequate flow of air is detected 20 within the engine compartment 98, verifying that the exhaust or ventilation fan 92 is operating properly, a predetermined time delay begins 22. During the predetermined time delay, the exhaust fan 92 maintains the flow of fresh air through the engine compartment 98. During the predetermined time delay, the engine of the boat is disabled and may not be started. Once the predetermined time delay expires, boat ignition safety apparatus 10 again allows the engine of the boat to be started 24. However, in the event the air pressure sensor 96 (see FIG. 3) determines that the air flow is not adequate 26 to remove the gasoline or other fumes from the engine compartment 98, the user is prevented from starting 28 the engine. Unless the air pressure sensor 50 detects adequate air flow for the duration of the predetermined time delay, the engine will not be allowed to start. For example, if half way through the predetermined time delay the air pressure sensor 50 no longer detects positive air flow in the engine compartment 98, the predetermined time delay will be reset and start over upon the next detection of positive air flow by air pressure sensor 50.

Additionally, a user also has the option in an emergency to by-pass the boat ignition safety apparatus 10 by actuating a by-pass safety switch 30. By activating the by-pass switch 30, the user can immediately start 32 the engine. This feature of the present invention allows the user to start the engine immediately. This can be advantageous in that it allows the user to avoid a collision with another boat or other source of imminent danger. To provide as much safety as possible to boaters, in an alternate embodiment of the by-pass function the exhaust or ventilation fan 92 is automatically started or remains operating upon actuation of the by-pass switch 30. This provides for some ventilation in an emergency, which is always preferable to no ventilation. While safety dictates that there be some means for by-passing the boat ignition safety apparatus 10, having a by-pass safety switch 30 can be an invitation for abuse by impatient boaters.

To help protect boaters from themselves, a further contemplated embodiment of the by-pass safety switch 30 includes a time limitation on its use imposed by the boat ignition safety apparatus 10. Thus, when the by-pass switch 30 has been engaged the engine would only operate for a predetermined time period sufficient to avoid an emergency. Although not shown, one of ordinary skill in the electronic arts will recognize that the by-pass time limitation function could be implemented using circuitry similar to that used for the delay function shown in FIGS. 2 and 4–9.

FIG. 2 is a schematic diagram of the boat ignition safety apparatus of the present invention. The boat ignition safety apparatus 10 is comprised of an ignition switch 52 that when actuated, applies +12VDC 46 to terminal block 2 (TB2) 66, terminal 7 of latching relay 1 (LR1) 58 and to fan off indicator lamp 48. Instead of an ignition switch, apparatus 10 could include a sensor that detects when a preexisting ignition switch or actuator of a boat is initiated. This sequence of events has the effect of preventing the engine from being started until air flow has been proven to be adequate at air pressure sensor (APSS) 50. To initiate the boat ignition safety apparatus 10 and start the boat, the user must actuate blower fan switch 44, which engages the blower motor (BM1) 42. In an alternate embodiment, apparatus 10 detects the actuation of ignition switch 52 and automatically engages blower motor 42. The blower motor 42 provides positive air flow and a positive air pressure within the engine compartment, which is detected by air pressure sensing switch 50 causing the contacts of the air pressure sensing switch 50 to close and the fan indicator lamp 48 to turn off. When the contacts of air pressure sensing switch 50 close, +12VDC 46 is applied to both terminal block 1 (TB1) 64 and terminal A 76 of latching relay 58. Furthermore, terminals 4 and 7 of latching relay 58 close applying +12VDC 46 to time delay relay 1 (TDR1) 60, common node 70, normally open terminal 82 and terminal 8 of latching relay 58, which activates coil 78. Activating coil 78 has the effect of closing terminals 6 and 9 of latching relay 58, which activates coil 80 of time delay relay 60 and initiates the preset four (4) minute time delay of the apparatus 10. The relay logic, or combination of latching relays and time delay relays, is primarily responsible for controlling the functions of the boat ignition safety apparatus 10. In order to complete the preset four (4) minute timing cycle, air pressure sensing switch 50 must detect positive air flow in the form of positive air pressure for the full timing cycle otherwise the sequence is repeated until positive air flow is detected for the entire timing cycle.

Once the preset four (4) minute timing cycle is completed, time delay relay 60 opens normally closed terminal 72 and closes normally open contact 82. Next, +12VDC 46 is applied to terminal 74 of ignition switch 52 and illuminates run indicator lamp 56 thereby allowing the boat's engine to be started. Once the engine has been started and is running, the blower fan switch 44 can be turned off allowing the engine to continue normal operation until the ignition switch 52 is turned off. Once the ignition switch 52 is turned off the above sequence must be repeated in order to restart the boat's engine. As a further safety measure, a bypass switch 54 has been provided to give the user the ability to circumvent the boat ignition safety apparatus 10 in the event of an emergency. This allows the user of the boat ignition safety apparatus 10 to immediately start the boat's engine to avoid potential danger—such as a head on collision. Additionally, in the preferred embodiment, when the bypass switch 54 is activated the blower motor 42 is automatically started.

Figure 3:
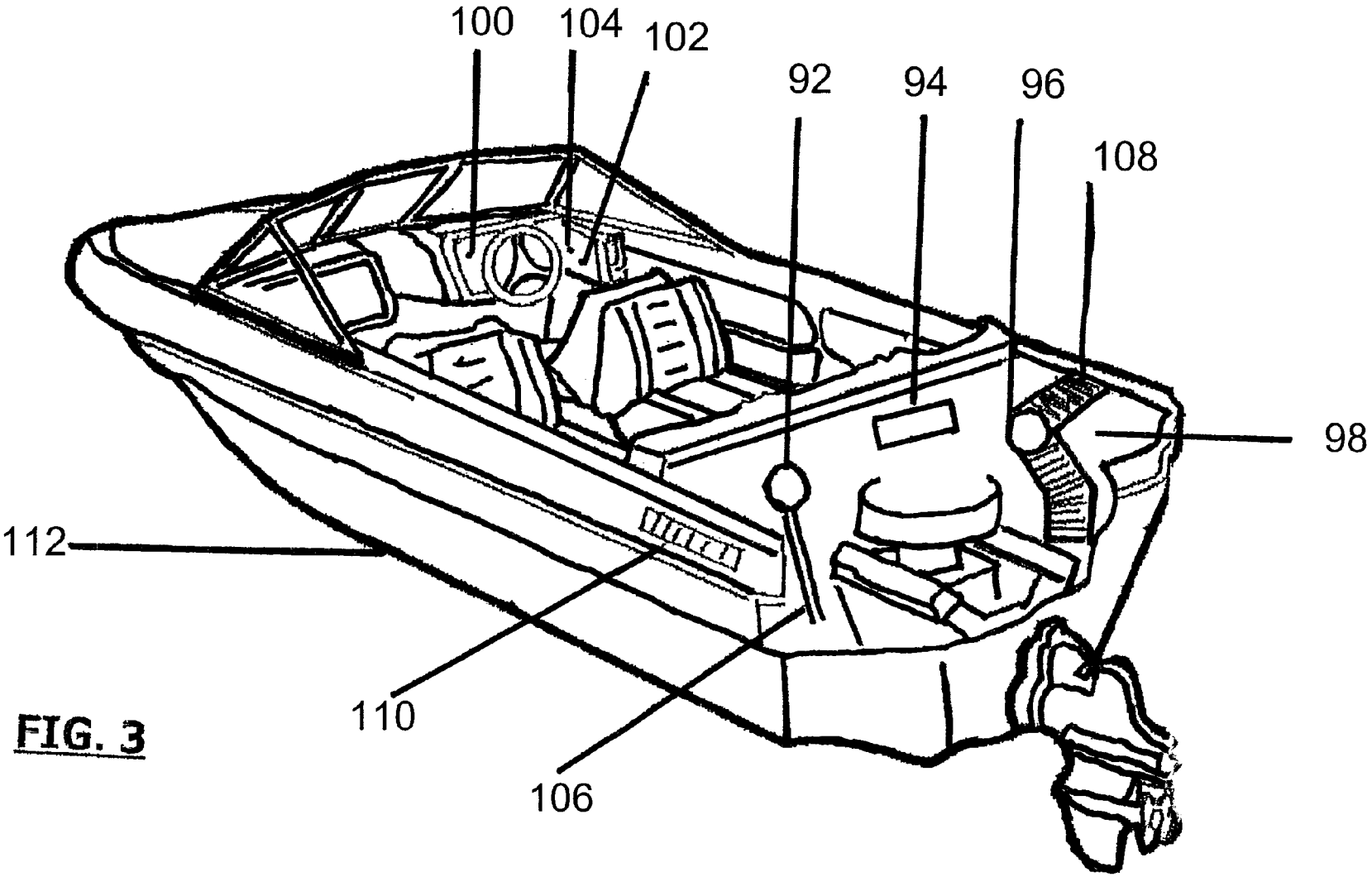
FIG. 3 is a perspective view of a boat equipped with the boat ignition safety apparatus of the present invention with the engine compartment shown partially cut-away.

FIG. 3 is a perspective view of a boat 112 equipped with the boat ignition safety apparatus 10 of the present invention with the engine compartment shown partially cut-away. Ordinarily, as a boat 112 is moving through the water, an adequate flow of fresh air is provided through the air inlet duct 110. However, when a boat is not being operated, volatile gasoline fumes can accumulate over a period of time within the engine's compartment 98, providing an environment that is conducive for an explosion. The present invention includes a ventilation fan 92 for evacuating contaminated air from the boat's engine compartment 98. Alternatively, ventilation fan 92 may be located in a remote location while being connected to exhaust ducting 108 in order to provide a ventilating flow of fresh air through the engine compartment 98.

Current federal regulations and safety guidelines suggest using a powered engine compartment ventilation system for at least four minutes before a boat is initially operated. Consequently, one object of the present invention is to assist in the reduction of boat explosions that result from the ignition of volatile fuel vapors that accumulate in the boat's engine compartment 98. To achieve this result, the present invention utilizes a number of sensing devices and timing relays. Specifically, apparatus 10 comprises an air pressure sensing switch 96 and timing relays contained in control module 94 to prevent engine ignition until air flow in the boat's engine compartment 98 has been established for a specified period of time.

The sequence of operation of the boat ignition safety apparatus 10 is initiated when the boat's user attempts to actuate the ignition switch 102. When this occurs, the control module 94 interrupts the ignition circuit and prevents the boat's user from being able to start the engine. The user must then turn on the ventilation fan 92, which provides positive air flow throughout the engine compartment 98. In an alternate embodiment, control module 94 automatically turns on ventilation fan 92 upon detection of an attempt to actuate the ignition switch 102. The ventilation fan 92 dissipates any fuel fumes that may have accumulated in the boat's engine compartment 98 as a result of the boat not having been operated. An air pressure sensing switch 96 monitors the flow of air via an air flow sensing tube 106 to ensure that clean, fresh air is being channeled through the engine compartment 98 by the ventilation fan 92. Once the air pressure sensing switch 96 determines that fresh air is entering the engine compartment, the electrical contacts of the air pressure sensing switch 96 are activated. The activation of the electrical contacts of air pressure sensing switch 96 initiates a timing circuit located within the control module 94. This timing circuit restricts the user from being able to start the boat's engine, as well as ensures that the ventilation fan 92 runs for a predefined period of time—four (4) minutes in one preferred embodiment. After a period of four (4) minutes has elapsed, the control module 94 completes the ignition circuit and illuminates the run indicator lamp 100 allowing the boat to resume normal operation. Once the engine has been started, the ventilation fan 92 can be turned off until the ignition switch 102 is again switched off.

To further enhance both boater and bystander safety, the present invention contains, an emergency bypass switch 104. Emergency bypass switch 104 allows a user to immediately start the engine of the boat, thus avoiding the time required to complete the sequences of the boat ignition safety apparatus 10. Furthermore, when the emergency bypass switch 104 is activated the ventilation fan 92 is automatically started. This feature provides as much immediate ventilation to the engine compartment 98 as possible in the time allowed by any impending emergency, as some ventilation in an emergency is better than none.

FIG. 4 is a schematic diagram of an alternate embodiment of the boat ignition safety apparatus 10. When the ignition switch 124 is initially activated, the +12VDC power source (battery) 122 is applied to the common contact C 146 of air pressures sensing switch (APSS) 126. The ignition switch 124 and the boat's existing starting circuit 144 are then interrupted until the user activates the engine compartment ventilation fan 92 (see FIG. 3). In an alternate embodiment, apparatus 10 automatically engages the ventilation fan 92 when the ignition switch 124 is initially activated. When the ventilation fan is activated, +12VDC 122 is applied to air pressure sensing switch 126 causing common contact C 146 and normally open contact NO 147 of air pressure sensing switch 126 to close. The closing of common contact C 146 and normally open contact NO 147 results in +12VDC 122 being applied to coil 130 of control relay (CR1) 128. As a result, control relay 128 closes normally open NO contact 148 and applies +12VDC 122 to time delay relay (TDR2) 136 and common contact C 150 of time delay relay (TDR1) 132. Time delay relays 132 and 136 initiate the timing cycle, which in a preferred embodiment is approximately four (4) minutes. When the timing cycle is completed, time delay relay 132 closes common contact C 150 and normally open contact NO 152. Time delay relay 136 closes common contact C 154 and normally open contact NO 156 which applies +12VDC 122 to run light 140, ignition return path 158 and starting circuit 144, thereby allowing the engine to resume normal operation. Finally, the run light 140 is contained within the control module 94 (see FIG. 3) and the auxiliary light 142 terminals are provided for external connection to the control module 94.

FIG. 5 is a schematic diagram of an alternate embodiment of the boat ignition safety apparatus 10, as shown in FIG. 4, depicting internal and external wiring connections. When the ignition switch 124 is activated, the +12VDC power source 122 is applied to common contact C 146 of air pressure sensing switch (APSS) 126. The ignition switch 124 and the starting circuit 144 are then interrupted until the user activates the engine compartment ventilation fan 92 (see FIG. 3). Once the user initiates the engine compartment ventilation fan 92, the +12VDC power source 122 is applied to air pressure sensing switch 126, which causes common contact C 146 and normally open contact 147 in air pressure sensing switch 126 to close resulting in the +12VDC power source 122 being applied to coil 130 in control module (CR1) 128. As a result, the control module 128 closes normally open contacts NO 148 and applies the +12VDC power source 122 to time delay relay (TDR2) 136 and common contact C 150 of time delay relay (TDR1) 132. Time delay relays 132 and 136 initiate the timing cycle, which in one preferred embodiment is approximately four (4) minutes. When the timing cycle is completed, time delay relay 132 closes common contact C 150 and normally open contact NO 152. Time delay relay 136 closes common contact C 154 and normally open contact NO 156, which applies the +12VDC power source 122 to run light 140 and starting circuit 144. This in turn allows the boat's engine to resume normal operation. Finally, the run light 140 is contained within the control module 94 (see FIG. 3) and the auxiliary light 142 terminals are provided for external connection to the control module 94.

Figure 6:
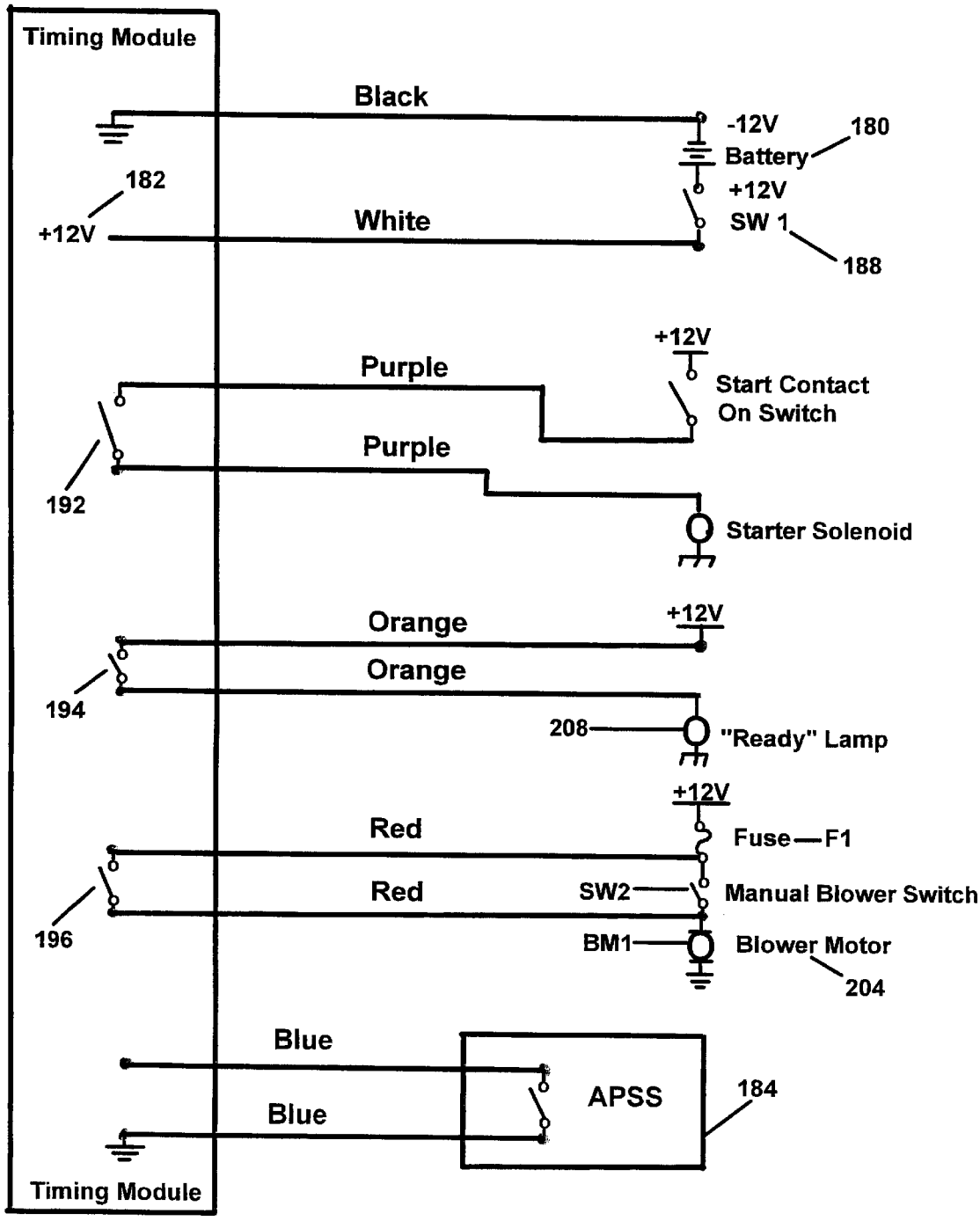
FIG. 6 is a schematic diagram of an alternate embodiment of the boat ignition safety apparatus.

FIG. 6 refers to an alternate embodiment of the boat ignition safety apparatus. The alternate embodiment is comprised of a timing module 186, which controls the functions of the boat ignition safety apparatus. Although not show, timing module 186 can be comprised of electromechanical relay logic, solid state and digital switches, or microprocessor or microcontroller circuitry. The use of digitally programmable control devices allows for advanced monitoring of air flow, reprogrammable time delays, and more versatile control of the engine. A person of ordinary skill in electronics would know that there are many ways to implement the control functions of the present invention and would be able to do so based upon the descriptions set forth herein. Therefore, FIG. 6 and several other figures disclose the functions of the present invention in the form of a timing module, which is an electrical or electronic black box for performing the recited functions.

When timing module 186 is actuated it receives +12VDC power 182 via switch 188, and battery 180, which causes internal switches 192 and 194 to open, and internal switch 196 to close, disabling the boat's ignition and starter circuits. Internal switch 196 starts the boat's ventilation fan or blower motor BM1 204. The blower motor 204 provides air flow in the engine compartment and creates positive air pressure within the engine compartment. When the air pressure sensing switch (APSS) 184 detects the positive air pressure it opens its contacts. The air pressure sensing switch 184 also removes the ground potential from internal connection 206 and starts the timing cycle. The timing cycle will continue for approximately four (4) minutes or some other predetermined time period.

If the boat's operator fails to turn on the manual blower switch SW2 190 before the timing cycle completes, the blower motor 204 stops, which in turn allows the positive air pressure within the engine compartment to dissipate. The air pressure sensing switch 184 detects the change in air pressure and opens its contacts preventing the boat's engine from starting. The timing cycle must be reset by turning off SW1 188 or by turning on the manual blower switch SW2 190.

When the timing cycle is reset and the blower motor 204 is turned on by the boat's operator, the timing cycle will continue to run for four (4) minutes plus or minus three (3) seconds. When the timing cycle completes and ready lamp 208 is illuminated, the boat's ignition and starter circuits are enabled and the engine may be started. Once the boat's engine is running the blower motor 204 may be turned off and the boat's engine will resume normal operation. Once the boat's engine resumes normal operation, the blower motor 204 may be turned on/off as needed.

Additionally, the boat's operator also has the option in an emergency to by-pass the timing module 186 by activating an emergency by-pass switch (not shown) allowing the boat's engine to be started immediately. This can be advantageous in that it allows the boat operator to avoid a collision or other source of danger.

Figure 7:
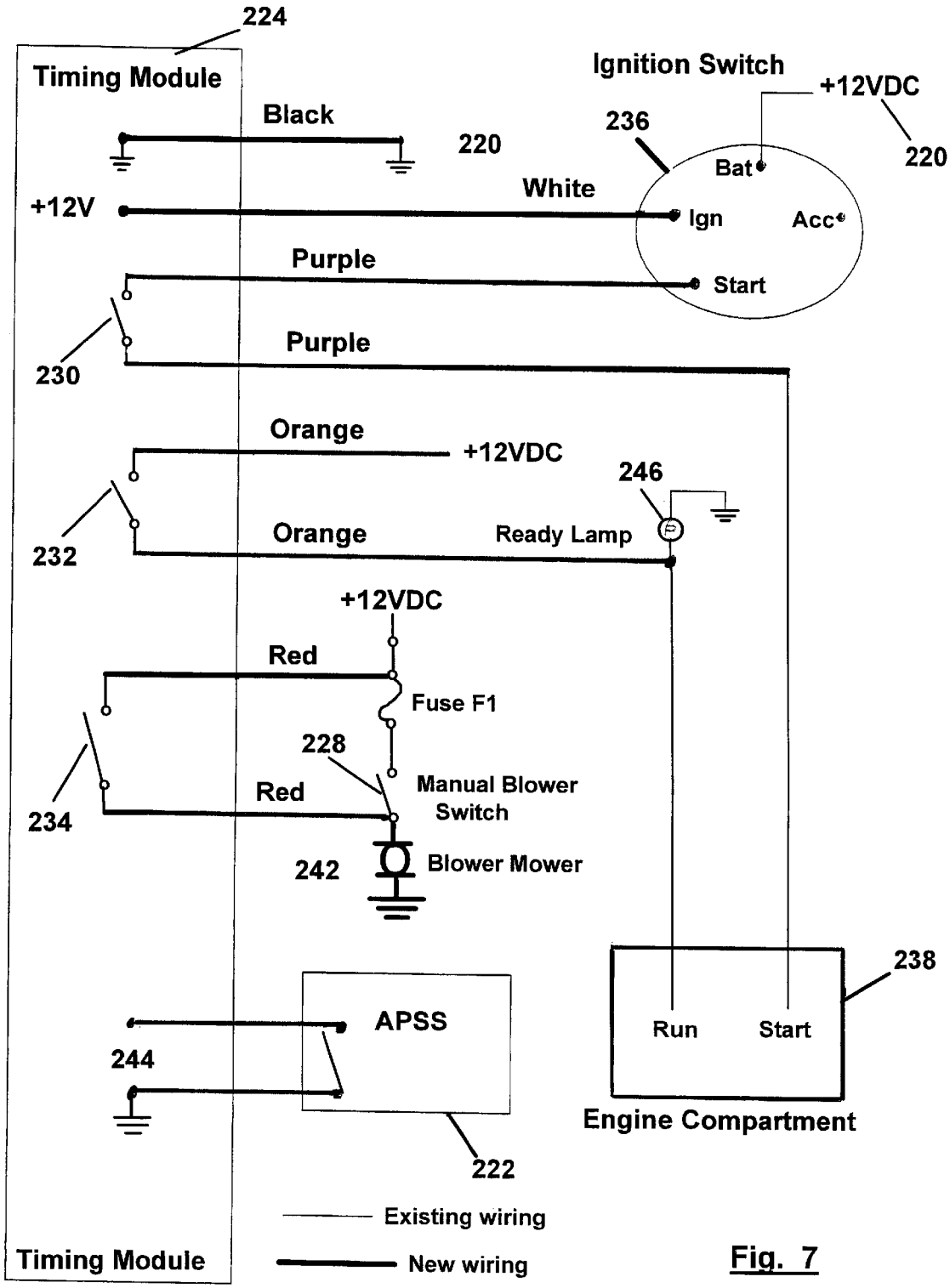
FIG. 7 is a schematic diagram of an alternate embodiment of the boat ignition safety apparatus.

FIG. 7 is a schematic diagram of an alternate embodiment of the boat ignition safety apparatus of the present invention. The boat ignition safety apparatus is comprised of a timing module 224, that when actuated, receives +12VDC power 220 supplied via the boat's ignition switch 236 which causes internal switches 230 and 232 to open, and internal switch 234 to close, disabling the boat's ignition and starter circuits 238. Internal switch 234 starts the boat's blower motor BM1 242. The blower motor 242 creates positive air pressure within the engine compartment, which is detected by the air pressure sensing switch (APSS) 222. As a result the air pressure sensing switch 222 opens its contacts and removes the ground potential from internal connection 244, thereby starting the four (4) minute timing cycle.

If the boat's operator fails to turn on the manual blower switch 228 before the timing cycle completes, the boat's blower motor 242 stops, which causes the air pressure sensing switch 222 to open its contacts thereby preventing the boat's engine from starting. In addition, the timing cycle must be reset by turning off the boat's ignition switch 236, or by turning on the manual blower switch 228.

When the timing cycle is reset and the blower motor 242 is turned on by the boat's operator, the timing cycle will continue to run for approximately four (4) minutes. When the timing cycle completes and ready lamp 246 is illuminated the boat's ignition and starter circuits 238 are enabled and the engine may be started. Once the boat's engine is running the blower motor 242 may be turned off and the boat's engine will resume normal operation. Once the boat's engine resumes normal operation the blower motor 242 may be turned on/off as needed.

Additionally, the boat's operator again has the option in an emergency to by-pass the timing module 224 by activating an emergency by-pass switch (not shown) allowing the boat's engine to be started immediately.

Figure 8:
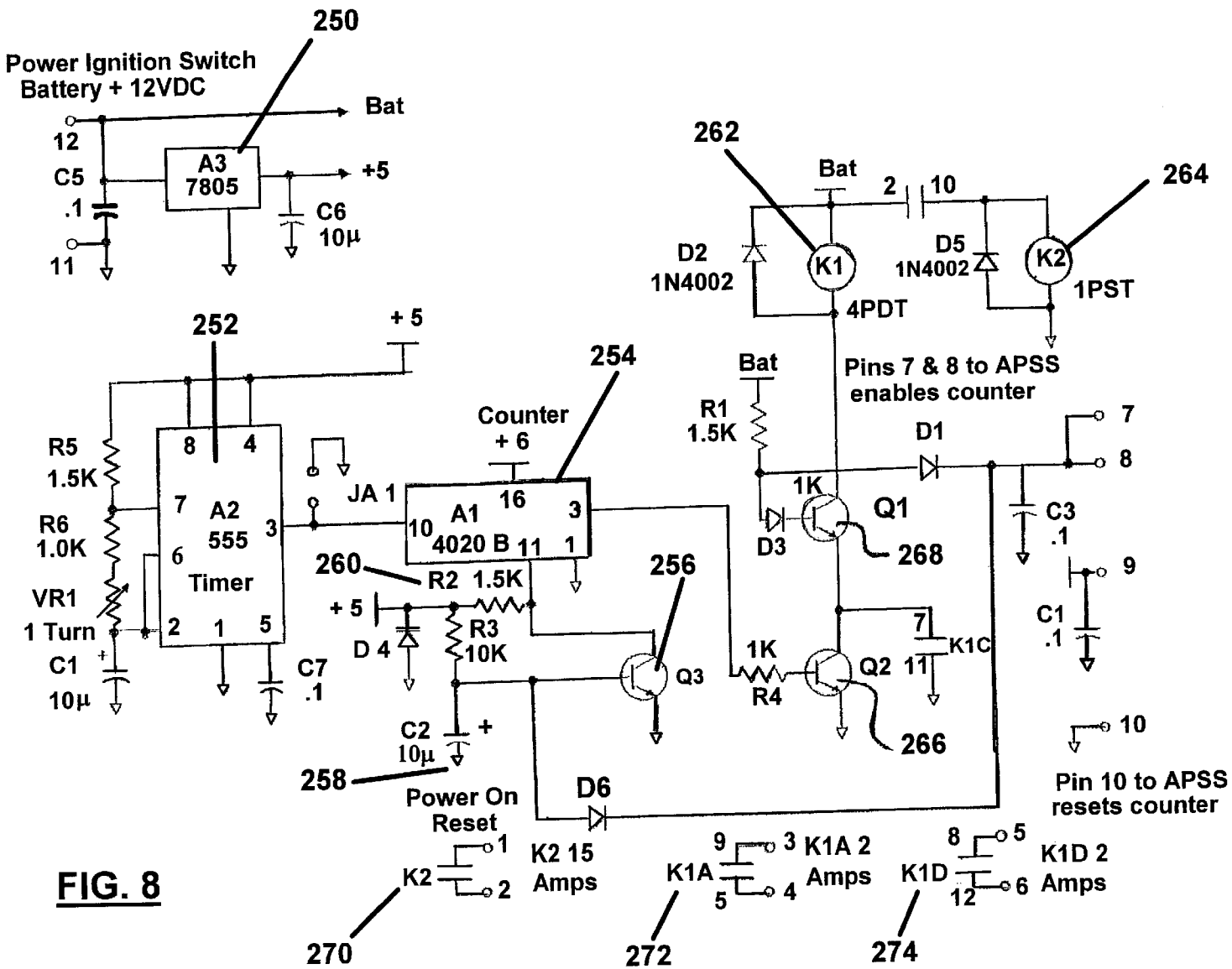
FIG. 8 is a schematic diagram of an alternate embodiment of the boat ignition safety apparatus.

FIG. 8. is a schematic diagram of an electronic circuit implementing an alternate embodiment of the boat ignition safety apparatus. Power is applied to the circuit through the boat's ignition switch with 12 VDC applied across pins 11 and 12 of the circuit. A 5 VDC regulator (A3) 250 produces a regulated +5 volts to the timing and control circuitry. With power applied, a precision timer (A2) 252 begins to produce clock pulses and binary counter (A1) 254 is reset due to a high logic level at pin 11. This high logic level is created by the power on reset delay circuit, which is comprised of transistor (Q3) 256 and the resistive-capacitive network (C2-R2) 258-260. If pins 7 and 8 are maintained at ground potential, the reset condition for the disclosed electronic circuit will continue.

While the circuit is reset, pin 3 will remain at a low logic level, which prevents relays K1 (262) and K2 (264) from energizing. In turn, this inhibits ignition and prevents starter motor power. Turning on the boat's ventilation fan and/or blower motor creates positive air pressure within an engine compartment, which air pressure sensing switch (external to circuit shown in FIG. 8) detects and forces pins 7 and 8 to a positive potential. If pins 7 and 8 are at a positive potential greater than 2 volts, delay capacitor (C2) 258 charges until it reaches approximately 0.7 VDC, and transistor (Q3) 256 conducts, which applies a low logic level on the reset input (pin 11) to counter (A1) 254, allowing counter operation to begin timing.

Counting continues until the instant 16,384 counts are registered and pin 3 of counter (A1) 254 goes high. With pin 3 high, transistors (Q1) 268 and (Q2) 266 will conduct, relays (K1) 262 and (K2) 264 will activate, thereby enabling the ignition and starter motor power when selected. Contact K1C (not shown) provides a latch so that additional clock pulses do not effect the enabled status of the circuit. Relay contacts (K2) 270, (K1A) 272 and (K1D) 274 close during the enabled status. The nominal time from end of reset to enabled status is approximately 4.1 minutes. Reset may be initiated at any time by grounding pins 7 and 8 for approximately 0.5 seconds or more. Timing will begin when the grounding of pins 7 and 8 is removed.

Figure 9:
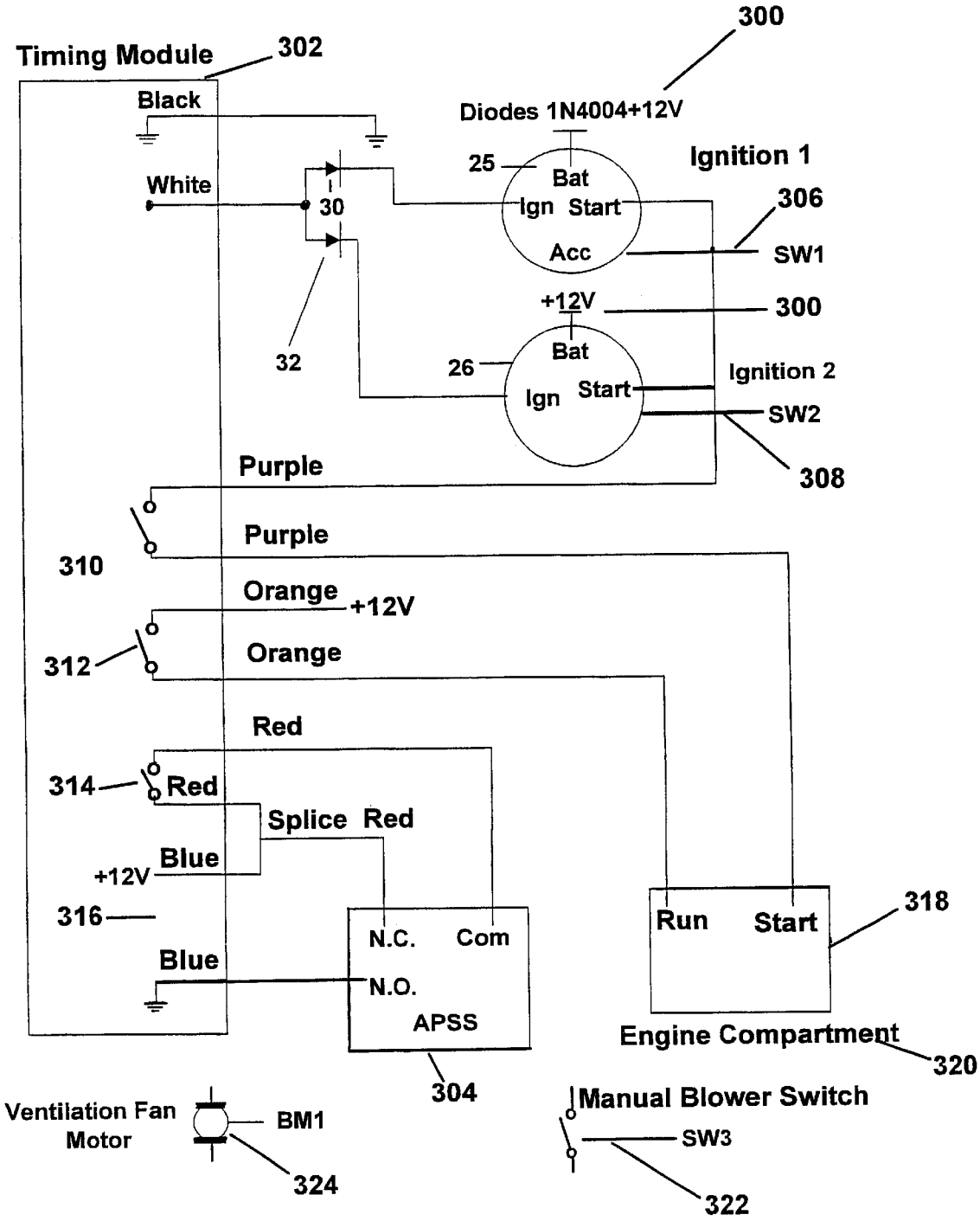
FIG. 9 is a schematic diagram of an alternate embodiment of the boat ignition safety apparatus.

FIG. 9 is a schematic diagram of an alternate embodiment of the boat ignition safety apparatus for use in boats having multiple engines. When ignition switches 306, 308, or the ignition switches for both engines are activated, +12VDC power 300 is supplied to the timing module 302, which causes internal switches 310 and 312 to open, and internal switch 316 to close, disabling the ignition and starter circuits 318 in the engine compartment 320. The internal switch 316 remains closed until the boat's operator turns on the boat's manual blower switch SW3 322, which starts the boat's ventilation fan or blower motor BM1 324. The blower motor 324 creates positive air pressure within the engine compartment sensed by the air pressure sensing switch (APSS) 304. This causes air pressure sensing switch 304 to open its contacts and remove the ground potential from the internal connection 316, which starts the timing cycle. The timing cycle will continue for approximately four (4) minutes or some other predetermined time period. If the boat operator turns off the manual blower switch SW3 322 or the air pressure is interrupted before the timing cycle completes, the air pressures sensing switch 304 will detect the change in air pressure and close its contacts. This in turn will stop the timing cycle and reset the timer to zero. This will continue until the air pressure sensing switch 304 detects that the air pressure has been restored. Until the positive air pressure is restored, the ignition and starter circuit 318 will remain disabled.

When the timing cycle is reset by restoring positive air pressure within the engine compartment, the air pressure sensing switch 304 closes its contacts and restarting the timing cycle for four (4) minutes. When the timing cycle completes, the ignition and starter circuit 318 is enabled, the engines may be started. Once the engines are running, the boat's blower motor 324 may be turned off. This causes the contacts on switch 314 to open thereby removing the ground potential at the internal connection 316 and allowing the engines to resume normal operation. Additionally, the boat's operator again has the option in an emergency to by-pass the timing module 302 by activating an emergency by-pass switch (not shown) allowing the engines to be started immediately.

Figure 10:
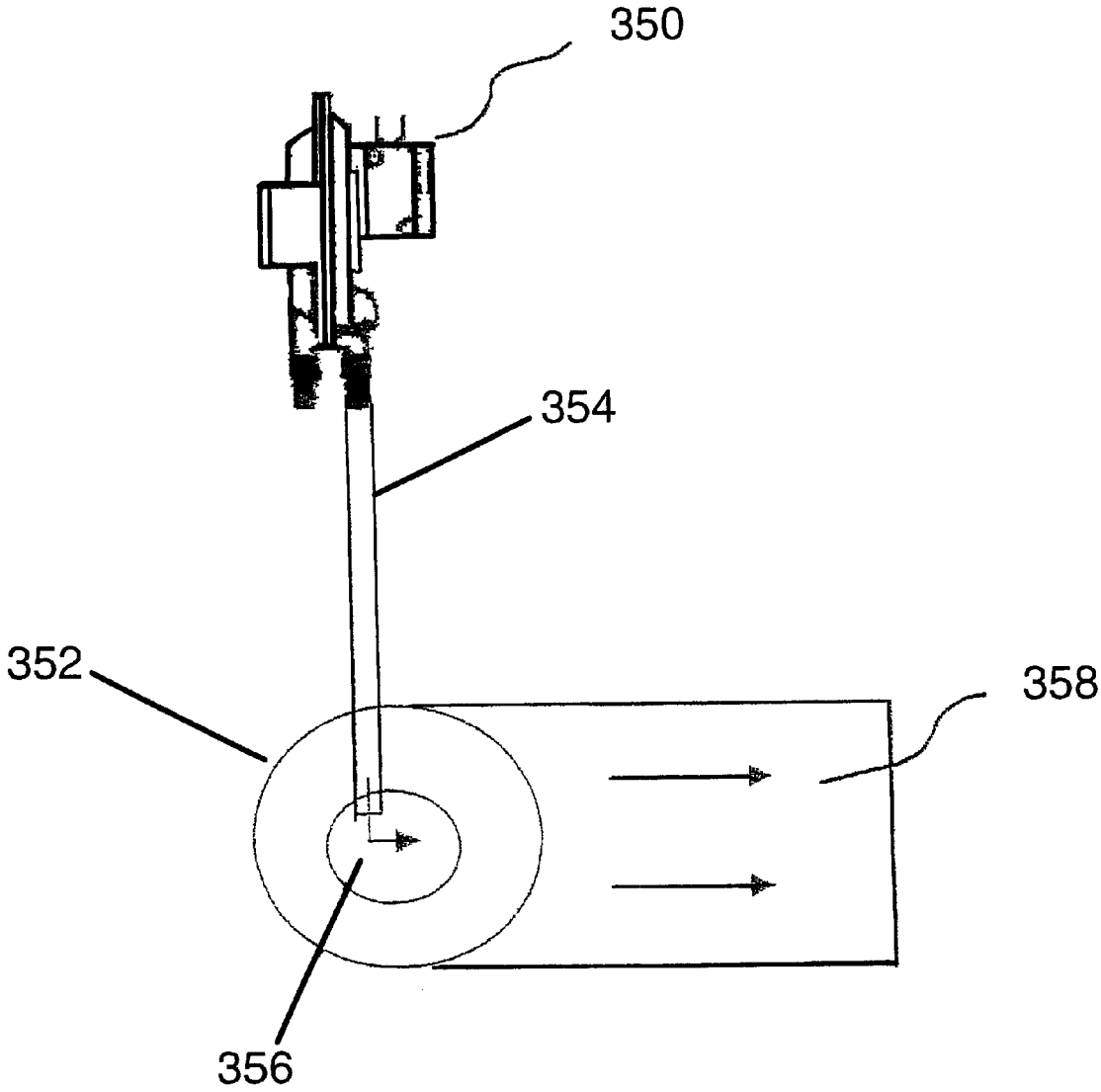
FIG. 10 is an elevational view showing an air pressure sensor used in the boat ignition safety apparatus to detect positive air flow within an engine compartment.

FIG. 10 is an elevational view illustrating the functionality of the air pressure sensing switch (APSS) 350. The air pressure sensing switch 350 may be located at any given location within the hull of a boat (see FIG. 3, 112) as long as the air pressure sensing tube 338 is located near the bottom of the engine compartment and above the normal bilge water line. When squirrel cage blower motor 352 is running, air enters through the air inlet 354 and exits through the air outlet 356, which creates a negative air pressure, within the air pressure sensing tube 338 thus activating the contacts in the air pressure sensing switch (APSS) 350. In this embodiment, instead of detecting positive air pressure within the engine compartment, the air pressure sensing switch 350 is preconfigured to sense the negative air pressure created at the blower motor 352.

Figure 11:
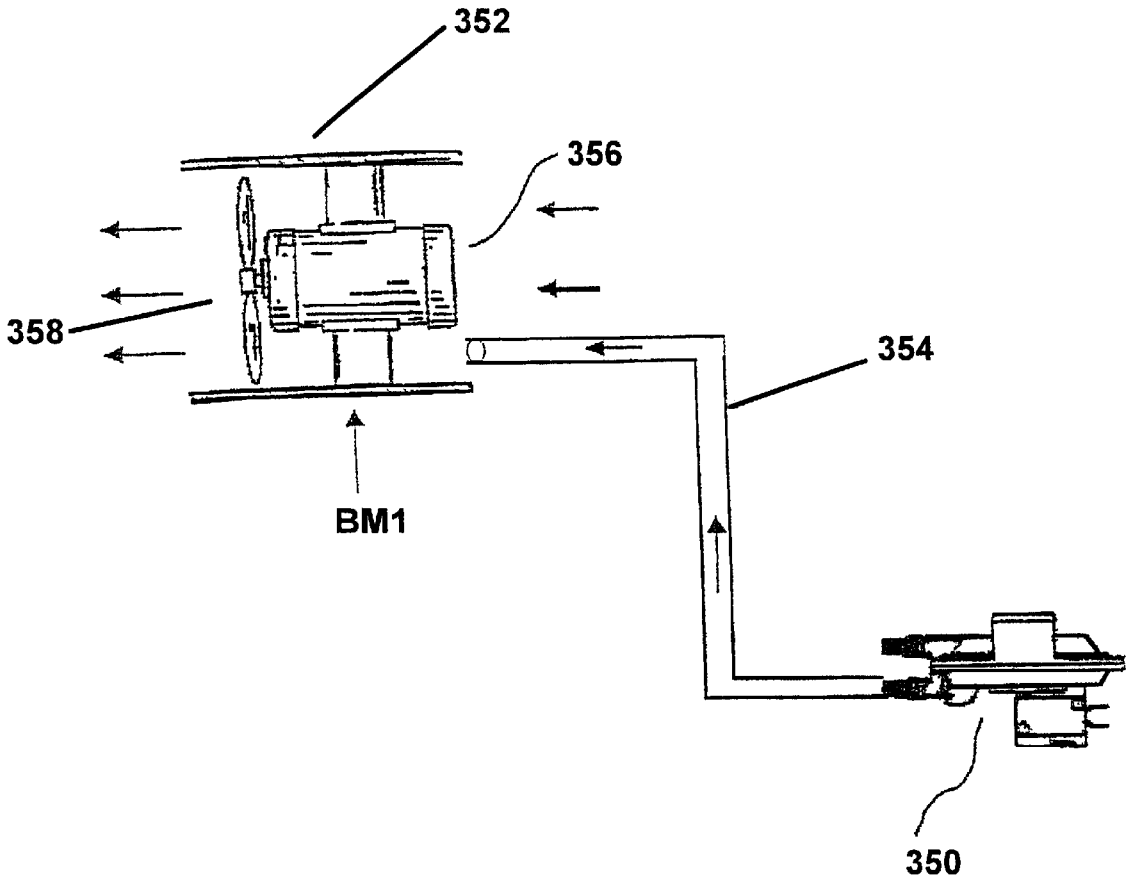
FIG. 11 is an elevational view showing an air pressure sensor coupled to an in-line blower motor in one embodiment of the present invention.

FIG. 11 is an elevational view illustrating the functionality of the air pressure sensing switch (APSS) 350 when used with an in-line blower motor 352. The air pressure sensing switch 350 may be located at any given location within the hull of a boat (see FIG. 3, 112) as long as the air pressure sensing tube 354 is located near the bottom of the engine compartment and above the normal bilge water line. When the in-line blower motor 352 is running, air enters through the air inlet 356 and exits through the air outlet 358, which creates negative air pressure within the air pressure sensing tube 354 thereby causing the air pressure sensing switch 350 to activate its contacts. This embodiment also takes advantage of negative air pressure rather than the earlier embodiments which monitor positive air pressure within the engine compartment.

Other variations are also contemplated within the scope of the present invention. For example, in lieu of relay logic in the form of electro-mechanical and time delay relays as illustrated, solid state and digital switches could be used. Additionally, the present invention may also be designed around microprocessor or microcontroller circuitry. The use of digitally programmable control devices would allow for advanced monitoring of air pressure and air flow, reprogrammable time delays, and more versatile control of the engine. The use of microprocessor technology, in conjunction with standard memory, communication and input/output devices, will also allow the boat ignition safety apparatus to monitor and store statistics related to its operation such as air pressure, air flow, use of the by-pass switch, failures, and other conditions. One of ordinary skill in the art of electronics will understand that a wide variety of data acquisition functions can be implemented using microprocessor technology, including but not limited to data storage, printing of monitored data, and wire/wireless transfer of information.

One or more embodiments of the present invention could also be used in conjunction with other types of machines in which fumes accumulate in enclosed or partially enclosed compartments. For example, the present invention could be used in conjunction with automobiles, aircraft, electrical panels that house gaseous emitting battery supplies, and other uses. The present invention can be adapted for use in any situation in which fumes need to be evacuating from an enclosed environment before further operations within that enclosed environment are undertaken.

Thus, while the form of the apparatus and method herein described constitutes the preferred embodiment of this invention, it is to be understood that the invention is not limited to these precise forms of the disclosed apparatus and methods, and that changes may be made therein without departing from the scope of the invention.

What is claimed is:

1. A boat ignition safety apparatus for use with at least one engine housed within an engine compartment comprising:

an ignition switch for starting said engine;

a controller that detects actuation of said ignition switch;

a ventilator for removing fumes from within said engine compartment, wherein said ventilator is operated by said controller; and a monitor for sensing air flow within said engine compartment based upon the air pressure within said engine compartment;

wherein said monitor provides the value of said air pressure to said controller; and wherein said controller prevents said engine from starting until said controller determines that sufficient air flow was continually present within said engine compartment for a predetermined period of time.

2. An apparatus as recited in claim 1, wherein said monitor for sensing air flow within said engine compartment is comprised of an air pressure sensing switch.

3. An apparatus as recited in claim 1, wherein said controller automatically activates said ventilator upon actuation of said ignition switch.

4. An apparatus as recited in claim 1, further comprising a by-pass switch that allows said engine to be started immediately.

5. An apparatus as recited in claim 4, wherein actuation of said by-pass switch activates said ventilator.

6. An apparatus as recited in claim 4, wherein said controller allows said engine to be started immediately upon actuation of said by-pass switch and operated for only a predetermined period of time.

7. An apparatus as recited in claim 1, wherein said controller is comprised of circuitry selected from the group consisting of relay logic circuitry, analog circuitry, digital logic circuitry, microprocessor circuitry and microcontroller circuitry.

8. An apparatus as recited in claim 1, wherein said ventilator is comprised of an exhaust fan coupled to said engine compartment.

9. An apparatus as recited in claim 1, wherein said ventilator is comprised of a blower motor coupled to said engine compartment.

10. An apparatus for use with at least one engine housed in a engine compartment, comprising:

a controller that detects an attempt to start said at least one engine;

a ventilator for removing fumes from within said engine compartment; and a monitor for sensing air flow within said engine compartment created by said ventilator;

wherein said monitor senses air flow by determining the air pressure within said engine compartment;

wherein said monitor provides information about the air pressure to said controller; and wherein said controller prevents said at least one engine from starting until said controller determines that sufficient air flow was continually present within said engine compartment for a predetermined period of time.

11. An apparatus as recited in claim 10, wherein said monitor for sensing air flow within said engine compartment is comprised of an air pressure sensing switch.

12. An apparatus as recited in claim 10, wherein said controller automatically activates said ventilator upon detection of an attempt to start said at least one engine.

13. An apparatus as recited in claim 10, wherein said controller is comprised of circuitry selected from the group consisting of relay logic circuitry, analog circuitry, digital logic circuitry, microprocessor circuitry, and microcontroller circuitry.

14. An apparatus as recited in claim 10, further comprising a by-pass switch that allows said engine to be started immediately.

15. A boat ignition safety apparatus for use with at least one engine housed in an engine compartment, comprising:

means for controlling said boat ignition safety apparatus;

means for detecting an attempt to start said at least one engine;

means for ventilating fumes from within said engine compartment;

means for monitoring air flow within said engine compartment created by said ventilating means;

wherein said monitoring means senses air flow by determining the air pressure within said engine compartment and then communicates said air pressure to said controlling means; and wherein said controlling means prevents said at least one engine from starting until said controlling means determines that sufficient air flow was continually present within said engine compartment for a predetermined period of time.

16. An apparatus as recited in claim 15, wherein said controlling means actuates said ventilating means upon detection of an attempt to start said at least one engine.

17. An apparatus as recited in claim 15, further comprising means for bypassing said apparatus thereby allowing said at least one engine to be started immediately.

18. An apparatus as recited in claim 15, wherein said ventilating means is activated by said controlling means whenever said by-pass means is employed.

19. A method of removing fumes from at least one engine housed in an engine compartment, comprising the steps of:

detecting an attempt to start said at least one engine;

ventilating fumes from within said engine compartment;

monitoring air flow within said engine compartment by determining the air pressure within said engine compartment; and preventing said at least one engine from starting until sufficient air flow has been continually present within said engine compartment for a predetermined period of time.

20. A method as recited in claim 19, wherein said fumes are automatically ventilated from within said engine compartment upon detection of an attempt to start said at least one engine.

* * * * *